US009538616B2

(12) United States Patent
Dijk et al.

(10) Patent No.: US 9,538,616 B2
(45) Date of Patent: Jan. 3, 2017

(54) TIMED LIGHTING CONTROL

(71) Applicant: PHILIPS LIGHTING HOLDING B.V., Eindhoven (NL)

(72) Inventors: Esko Olavi Dijk, Utrecht (NL); Koen Johanna Guillaume Holtman, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/419,328

(22) PCT Filed: Jul. 25, 2013

(86) PCT No.: PCT/IB2013/056110

§ 371 (c)(1),
(2) Date: Feb. 3, 2015

(87) PCT Pub. No.: WO2014/024078

PCT Pub. Date: Feb. 13, 2014

(65) Prior Publication Data

US 2015/0208489 A1 Jul. 23, 2015

Related U.S. Application Data

(60) Provisional application No. 61/680,349, filed on Aug. 7, 2012.

(51) Int. Cl.
*H05B 37/02* (2006.01)

(52) U.S. Cl.
CPC ..... *H05B 37/0254* (2013.01); *H05B 37/0245* (2013.01); *H05B 37/0272* (2013.01); *H05B 37/0281* (2013.01)

(58) Field of Classification Search
CPC ..... H05B 33/0815; H05B 33/0818; H05B 33/0884; H05B 33/0809; H05B 33/0848; H05B 33/0896; H05B 33/0803; H05B 37/029; H05B 37/0245; H05B 37/0254
(Continued)

(56) References Cited

U.S. PATENT DOCUMENTS 6,813,777 B1 * 11/2004 Weinberger ..... H04B 7/18508 348/E5.008
7,372,846 B2 5/2008 Zwack
(Continued)

FOREIGN PATENT DOCUMENTS

DE 202006006634 U1 9/2007
WO 2009090601 A1 7/2009

OTHER PUBLICATIONS

Mike Isaac; "Google's Plafform Extends its Reach With Android @Home", May 11, 2011, Gadget Lab, Hardware News and Reviews, pp. 1-5.
(Continued)

*Primary Examiner* — Douglas W Owens
*Assistant Examiner* — Syed M Kaiser
(74) *Attorney, Agent, or Firm* — Meenakshy Chakravorty

(57) ABSTRACT

The present invention defines a HTTP or CoAP request message that combines one or more HTTP or CoAP requests along with timing information (432-1). The message is sent by a control device (132) to a network proxy (i.e. a network router (112)) via a control network (120). The network proxy decodes the message and subsequently controls destination devices, in particular luminaires (L1, L2, L3, L4), in a timed manner using the HTTP or CoAP requests. The network proxy is application-independent and also enables control of third party HTTP-or CoAP-based devices that are not aware of timed requests. Improved timing performance is obtained
(Continued)

by choosing the network proxy location "close by", in terms of network hops and/or latency, to the destination devices to be controlled.

15 Claims, 4 Drawing Sheets

(58) Field of Classification Search
USPC ..... 315/294, 159, 175, 362, 160
See application file for complete search history.

(56) References Cited

U.S. PATENT DOCUMENTS

| | | | | |
|---|---|---|---|---|
| 2002/0050799 | A1 | 5/2002 | Yamauchi et al. | |
| 2003/0169728 | A1 | 9/2003 | Choi | |
| 2005/0195862 | A1 | 9/2005 | Jones et al. | |
| 2009/0013330 | A1 | 1/2009 | Gotz et al. | |
| 2010/0106836 | A1 | 4/2010 | Schreyer et al. | |
| 2010/0271802 | A1* | 10/2010 | Recker | H05B 33/0803 362/20 |
| 2010/0327766 | A1* | 12/2010 | Recker | H02J 9/02 315/291 |
| 2011/0133655 | A1* | 6/2011 | Recker | H02J 9/02 315/159 |
| 2012/0043889 | A1* | 2/2012 | Recker | H05B 33/0815 315/86 |

OTHER PUBLICATIONS

"Synchronized Multimedia Integration Language", http:/en.wikipedia.org/wiki/Synchroinzed_Multimedia_Intregation_Language.

Shelby et al; Constrained Application Protocol (CoAP), draft-ietf-core-coap, version 06, May 2011, http://tools.ietf.org/html/draft-ietf-core-coap-06.

G. Montenegro et al; "Transmission of IPv6 Packets Over IEEEE 802.15.4 Networks", RFC 4944, Sep. 2007, http://www.rfc-editor.org/rfc4944.txt.

* cited by examiner

TIMED LIGHTING CONTROL

CROSS-REFERENCE TO PRIOR APPLICATIONS

This application is the U.S. National Phase application under 35 U.S.C. §371 of International Application No.PCT/IB13/056110, filed on Jul. 25, 2013, which claims the benefit of U.S. Provisional Patent Application No. 61/680,349, filed on Aug. 7, 2012. These applications are hereby incorporated by reference herein.

FIELD OF THE INVENTION

The present invention is directed to a method of controlling a lighting system, a lighting control system, a control device for controlling a number of luminaires and a network router for controlling a number of luminaires. The present invention is specifically related to generating a control message in a lighting system, wherein the control message includes both command information and timing information. The present invention is further directed to a corresponding computer program.

BACKGROUND OF THE INVENTION

US 2002/0050799 A1 describes a lighting apparatus for controlling lighting loads. The apparatus is connected to a network via a network interface and receives commands from the network that are to be forwarded to the lighting loads, when the apparatus is in an automatic mode. In a manual mode, the apparatus receives direct user instructions not from the network but from a remote control and forwards corresponding commands to the lighting loads. The network interface further comprises a protocol processing part and a memory for storing time information. Said time information means absolute time, such as date and time, or relative time, such as hours after a zero time point, or count information, such as a pulse at a specific time point after counting a number of pulses from a reference time point in a clock oscillator or in a commercial electric power frequency. The time information is received via the network. The apparatus controls the lighting loads based on the timing information. It is described that, during enjoying a movie, light intensity and color of lighting are changed by linking up an audio-visual unit, such as a television set, to the lighting apparatus to improve a so-called stage effect.

SUMMARY OF THE INVENTION

It is an object of the present invention to provide means that allow for low-complexity and low-cost, yet precise and robust, timing control of a lighting system that can easily be implemented in an existing lighting system without requiring employing a radically new network protocol.

According to a first aspect of the present invention, a method of controlling a lighting system is presented. The lighting system comprises a number of luminaires, a network router configured to be coupled to the number of luminaires and a control device configured to be coupled to the network router via a control network. The method includes the steps of:

providing, by the control device, a control message, the control message including timing information and command information;

receiving, by the network router, the control message via the control network and determining a first point in time in dependence on the timing information;

generating, by the network router, a command in dependence on the command information; and forwarding, by the network router, at the determined first point in time the command to at least one of the number of luminaires identified in the control message.

The present invention includes the recognition that, according to the prior art, precise timing of a set of commands is not possible in such a lighting system scenario, in particular due to the "long" distance caused by a heterogeneous control network between the control device and the luminaires. The synchronization requirement cannot sufficiently be met when putting into practice the teaching of the prior art. The control network that interlinks the luminaires with the control device can include many components, such as servers, base stations, network controllers, routers, switches, hubs and so on. Therefore, a command submitted by the control device may travel quite a long way before it reaches the luminaire. Such a long way may include a plurality of so-called "hops", e.g., a change in the type of the physical layer, e.g. from a wireless to a wired communication path. This may lead to various, and in particular unpredictable, latencies. The latencies may also strongly depend on the state of the network and its routers. Such latencies are undesirable when the aim is to precisely control luminaires with regard to timing issues. For instance, a first luminaire might have to be turned on/off at exactly the same point in time as a second luminaire or an exact time period before/after turn-on/turn-off of the second luminaire. Such requirements are found, for instance, in specific lighting installations where the timing of lighting control is important. While the above mentioned timing problems usually do not occur if the control device is directly coupled, i.e., only by a physical layer link, to the luminaires, the situation is found to be entirely different when the control device is coupled to the luminaires via a possibly large control network and the "distance" (in terms of hops and/or network latency) between the control device and the luminaires is rather long, as elucidated above.

According to the invention, a new type of control message is defined that combines the command information, e.g. a Hypertext Transfer Protocol (HTTP) and/or a Constrained Application Protocol (CoAP) command, with the timing information. Such control message is generated by the control device and can be provided, via the control network, to the network router, e.g. a network proxy, such as a proxy server, that is positioned much closer (in terms of network hops and/or network latency; not necessarily in terms of a physical distance) to the number of luminaires than the control device. The network router can then decode the control message, in particular the timing information, and subsequently control the number of luminaires in a timed manner by submitting the generated command, e.g. a generated CoAP or HTTP command, at the determined first point in time. Preferably, the network router is entirely application-independent and also allows for control of a luminaire that "is not aware" of this new type of control message.

Thus, according to the invention, not only the control device takes care of precise timing, but, precise timing control can in particular be achieved by a further device that is much closer (in terms of network hops and/or network latency) to the luminaires. Further, handling of the above-mentioned unpredictable and varying network latencies is now possible. Such network latencies have substantially no influence on timing matters anymore, as the command is now finally submitted by the network router in a timely controlled manner. The control device generates the timing information, but the actual commands are submitted by the network router at the specific points in time that are determined in dependence on the timing information.

Hence, the invention allows for relocating final submission of a command away from the control device (that can be far away from the luminaires in terms of network hops and/or network latency) to the network router (that is located close to the luminaires). The network router does not blindly forward a received control message as soon as it arrives, but derives the command from the control message, i.e., in dependence on the command information, and forwards the generated command in accordance with the timing information to the identified at least one of the number of luminaires. Thus, the network router not only acts as a switch or hub or the like but additionally performs computation of points in time for forwarding a command to the luminaire.

As a result, the present invention allows for exact time control of one or more luminaires installed in an above-sketched scenario, i.e., luminaires being installed comparatively far away (in terms of hops and/or network latency) from the control device but close to the network router, e.g. due to a large heterogeneous control network between the control device and the network router. If multiple luminaires are present, these luminaires can be controlled simultaneously. For implementing such exact timing control, substantially no additional components have to be installed, and, in particular, the luminaries do not necessarily need to be adapted in order to be compatible with such a new control mechanism. Therefore, the present invention provides a simple, low-complexity and low-cost solution to the technical problem of a precise time control of a lighting system.

In other words, a main advantage of this invention is that complex timed control sequences can be executed with precise timing performance in an entirely application-independent manner, wherein the devices to be controlled (i.e., the luminaires) may be any combination of devices produced by the Applicant (PHILIPS) and/or any combination of third party IP (Internet protocol) controllable devices.

Within the description of the present invention, the wording "luminaire" refers to any kind of lamp that is capable of being coupled to and controlled through a control network, e.g. an IP-based control network. Such a luminaire is preferably a luminaire with a HTTP-interface or a CoAP-interface. Preferably, at least some or all of the number of luminaires are arranged in a second network, such as a local network, such as an IEEE 802.15.4 network. Further exemplary embodiments are given below.

Preferably, the network router is/includes a network proxy, such as a proxy server.

Features of embodiments described above and hereinafter may be combined with each other for the sake of designing further embodiments, as long as the features are not explicitly described as being alternative to each other.

The control message is preferably a Network layer protocol message (i.e., a layer 3 message in the sense of the Open Systems Interconnection (OSI) model), such as an Internet Protocol (IP) message.

The command information preferably includes a number of Application Layer protocol commands (i.e., a layer 7 command in the sense of the OSI model), such as a HTTP command and/or a CoAP command. Preferably, the network router extracts such Application Layer protocol commands out of the control message and forwards it to the identified luminaire(s) at the determined first point(s) in time.

In an embodiment, the HTTP command included in the command information is a HTTP Request and/or the CoAP command included in the command information is a CoAP-Request.

Preferably, both the command information and the timing information are included in a payload section of the control message.

In a first example, the command information includes a protocol header, such as a User Datagram Protocol (UDP) header, a HTTP header or a CoAP header, with an identifier contained therein, the identifier identifying one or more of the number of luminaires. The command information further includes a command payload section in which the actual command (e.g., "on", "off", "intensity=4", "dimming=on" and so forth) is contained, such as the payload section of a HTTP command or CoAP command.

In a second example, the command information is substantially entirely encoded in a command Uniform Resource Locator (URL). Such a URL can look like, e.g. "coap://lamp1.domain.example.com/set?level=23&status=on". Such a URL further includes the identifier that identifies the luminaire(s) to which the command is to be forwarded.

In a third example, the command information includes a specification that specifies the type of command contained in the command information, such as the CoAP/HTTP requests "GET", "PUT", "POST", "DELETE" and so forth. Such command information further includes a URL as well as a payload section. The payload section allows for integrating more specific lighting control commands, such as dimming time intervals, light intensity values, color values and so forth. In this example, the identifier is also included in the URL.

In a fourth example, the command information corresponds to the third example, wherein the identifier is not included in the URL, but the command information includes an explicit target device identifier, such as an IP address or an IP host name. Thus, instead of providing a complete URL, e.g. only an URL path and optionally URL query parameters are provided. In comparison to the second example, such a URL path can look like, e.g. "set/lamp/1". The payload section of such control message may include a command expressed as, e.g., "level=23;status=on;color=1234".

Further, in all the above mentioned examples, the command information is preferably coupled to the timing information that specifies the point(s) in time at which the command is to be submitted to the identified luminaire(s) by the network router. Thus, the timing information constitutes information that indicates at which point(s) in time the network router submits the commands according to the command information, which preferably includes an Application Layer protocol command, such as a HTTP command and/or a CoAP command, to the identified luminaire(s).

In particular, it is preferred that the timing information constitutes information indicating at which point(s) in time the command(s) shall be received by the identified luminaire(s).

Hence, in a preferred embodiment, the method includes determining, by the network router, a time period that a command submitted by the network router to a respective luminaire needs for travelling from the network router to the respective luminaire. The determined time period is preferably stored in the network router for each luminaire connected to the network router. Determination of such a travel time period is done, in an embodiment, by measuring Round Trip Times (RTT) for each luminaire.

It is furthermore preferred that determining the first point in time in dependence on the timing information contained in the control message includes considering the determined time period. Thus, the timing information can specify a point in time at which the command shall be received by a respective luminaire. The network router thus calculates the point in time of submission of the command in dependence on such target reception time and the measured time period.

Further specific embodiments of the control device, the network router, the control network and of the above mentioned control message are given further below.

In a preferred embodiment, the command information contains information about more than one command; and the timing information contains information that specifies the points in time when each of the commands is to be submitted to the one or more luminaires or when each of the commands is to be received by a respective luminaire. Hence, the command information can include, for instance, a plurality of protocol requests, and the timing information may include information about a respective point in time for each of the plurality of protocol requests. It can also be specified in the timing information how often a command is to be forwarded to a luminaire.

For instance, the command information includes one or more of the following: a number of PUT requests, a number of GET requests and/or a number of POST requests according to HTTP or according to CoAP. This will be explained in more detail further below. Certainly, the command information may include more than two of such requests.

In another embodiment, the method further comprises the steps of determining, by the network router, a second point in time in dependence on the timing information; and forwarding, by the network router, the command to the same and/or to another one of the number of luminaires.

Thereby, a synchronized control of one or more luminaires is achieved. For instance, the second point in time is a point in time after the first point in time, at which another luminaire is to be turned off/on or a light intensity level is to be adapted. Or, the same luminaire is turned on at the first point in time and turned off at the second point in time. Thereby, a periodic control of one or more luminaires can easily and accurately be implemented.

In an example, the control device sends a control message with embedded commands C1 at time t=0, C2 at time t=2s and C3 at time t=2s. Upon reception of this message, the network router starts a timer t=0. Immediately (at time t=0), it sends out command C1 which is addressed to a first luminaire. After a period of waiting until the timer reaches t=2s, it sends out in sequence the commands C2 and C3 to a second and a third luminaire, respectively, wherein C3 is sent as soon as possible after C2.

For instance, the command information includes a HTTP-request and/or a CoAP-request embedded in the control message verbatim or in some other encoded form.

Preferably, the timing information describes when each application protocol request contained in the command information will be made and optionally also how often.

For instance, the timing information describes

- an absolute time having no reference to a previously established timer but to an internal clock running in the network router and/or in the control device; and/or
- a relative time having reference to a previously established temporary timer running in the network router and/or in the control device and/or having reference to timing information established via a previous communication between the control device and the network router.

In an embodiment, the relative time is specified by an integer representing the number of milliseconds since the time of reception of the control message by the network router. When a time t=0 is specified, the network router forwards the command related to that timing information as soon as possible. When a time t=1000 is specified, the network router waits until an internal timer of the network router indicates that 1 second has passed since reception of the control message that contained the command. The timer that is preferably included in the network router is, in an embodiment, a standard software-implemented timer as realizable on any embedded computer platform. The timing information (e.g., an integer number as above) can be encoded in the control message using a method of choice, e.g., ASCII encoding with variable length or a fixed length binary encoding such as big-endian UINT32.

In another embodiment, the network router includes an absolute time reference implemented as a Real Time Clock. In this case, the control device preferably includes absolute time information in a suitable format in the control message, e.g. an ISO8601 date-and-time format, which allows specifying an ASCII string with date, time and decimal fractions of a second.

Alternatively, the first control message sent by the control device includes a reference to a named timer, which is not an absolute time reference in the above sense, but a relative time reference, which the network router software creates upon reception of the first message. Then, a second control message sent by the control device may reference this named timer, which makes the network router interpret all timing values with respect to this named running timer. For example, the first control message contains a single command C1 to be sent at time t=0 ms and names a timer "timer83AF04B938E2197A" which includes a unique ID known to the control device. The network router then creates a new named timer variable and sets it to zero initially. A second control message from the control device contains commands C1 to be sent at time t=2500 ms and C2 to be sent at time t=3500 ms and a reference to named timer "timer83AF04B938E2197A", which is recognized by the network router as an already running timer.

In a preferred embodiment, the method comprises the additional steps of:

- providing, by the control device, a second control message, the second control message including second timing information and second command information;
- receiving, by the network router, the second control message via the control network; and, if the determined first point in time has not yet occurred:
- discarding, by the network router, the command information contained in the control message received earlier than the second control message.

As has been elaborated above, the command information may contain more than one command and the timing information may contain information about more than one point in time, namely information about points in time when each of the commands is to be received by a respective luminaire or is to be forwarded by the network router. Thus, it shall be understood that the wording "first point in time" means, in this embodiment, a point in time associated with a command of the earlier control message that has not been submitted yet by the network router. Thus, commands contained in the earlier control message that have not been submitted by the network router at the time point of arrival of the second control message are preferably discarded.

This embodiment is in particular advantageous for dealing with lost or out-of-order control messages in the network path(s) from the network router to the luminaire(s) and path(s) from the control device to the network router. The control device may have sent the first control message before the second control message or may have sent the second control message before the first control message.

In a first variant of this embodiment, timing information contained in a later control message (i.e., in the second control message) does not reference any absolute/previously established timer. In this case, at least the following modes exist:

1) "Cancel all later commands": For each luminaire, the network router cancels/discards any pending forwarding events (i.e., commands to be forwarded that were obtained from control messages sent earlier) that would be sent out later than a command specified in the second control message. So the second control message always wins in case of conflict.
2) "Additive": any pending forwarding events are kept and new ones from the second control message are simply added. This may lead to a mixture of commands from the first (earlier received) and the second control message being sent to a luminaire. Rendering results may be unpredictable.
3) "Controllable": the network router switches between modes 1) and 2) on a per-control-message basis or as part of a network router configuration. To achieve this third mode, the control device may send a switch command for instructing the router to switch between the two modes.
4) "Controllable per timed command": as mode 3), but now the network router switches between modes 1) and 2) in dependence on each individual command contained in the second control message.

In a second variant of the abovementioned embodiment, timing information contained in the later control message references an absolute timer or a timer previously established in the network router. In this case, at least the following modes exist:

1) "Cancel all later commands": For each luminaire, the network router cancels/discards any pending "forwarding events" scheduled at a time $t>=\min(t_i)$, where $t_i$ are the time values in the second control message for a respective luminaire.
2) "Cancel duplicates only": For each luminaire, the network router cancels/discards any pending "forwarding events" derived from the first control message that are scheduled exactly at the same points in time $t_i$, where $t_i$ are time values included in the second control message for a respective luminaire.
3) "Additive": as mode 2) of the first variant.
4) "Controllable": as mode 3) of the first variant.
5) "Controllable per timed command": as mode 4) of the first variant, but now controllable for each timed command individually.

In an embodiment, the method includes the step of applying, by the network router, a Domain Name System (DNS) resolver to at least one host name being included in the received control message. This allows for converting an authority (i.e., a server name) in a URI with a symbolic authority in a CoAP or HTTP request to an IP address of a luminaire. Thus, the resolved IP address is an IP address of one of the luminaires identified in the control message.

The control message itself is not converted, only a lookup is done to convert a luminaire identified in the control message (e.g., "luminaire01.room3.floor5.building34.example.com") into an IP address. The IP address allows the network router to send an IP packet containing the command to the luminaire. So the control message with the command remains the same, only the identifier is changed.

Alternatively, the control device implements this conversion instead of the network router. Both approaches have their specific merits and the choice may depend on the network configuration. For example, the actual IP address of the luminaire may not be known to the control device but only its hostname (i.e. server name or authority). Then, the control device needs to do a DNS lookup ("resolve" operation) to obtain the IP address; but it could also delegate this to the network router who may know already the IP address from previous control messages executed after receiving these from other control devices. As a result, this saves time as the control device is not required to do the conversion.

In a preferred embodiment, the network router includes a network proxy, such as a Proxy server. Thus, the network router acts as an intermediary for control messages from the control device seeking resources, i.e. the luminaires, from other servers. In an embodiment, the control device connects to the network router including the network proxy and requests, via the control message, some service, such as a file, a connection, and/or a web page, or other resource available from a luminaire. The network proxy evaluates the control message and derives both the command and the first point in time therefrom. It submits the derived command to the identified luminaire, such that the command reaches the luminaire at a point in time specified in the timing information.

In a further preferred embodiment, the network router additionally or alternatively includes a 6LoWPAN (IPv6 over Low Power Wireless Personal Area Network) Border Router or other Router. Thereby, the luminaires operating over a network implementing the 6LoWPAN standard can be directly coupled to and addressed by the network router. Preferably, there is not more than one network hop between a luminaire and the network router. In an alternative embodiment, the network router couples to the luminaires using a ZigBee or other non-6LPowPAN-based, 802.15.4-based network, or any other network not based on the use of IP packets. In this embodiment, the network router acts as a type of router, but also as a type of protocol network router, because non-IP packets are used to convey commands at the luminaire coupling network side.

It is generally preferred that one or more of the following parameters of a control path between the network router and the number of luminaires is/are lower than corresponding parameters of a control network path between the control device and the number of luminaires: an average latency, a variance of latency, a number of hops, a packet loss rate. The longer path between the luminaires and the control device occurs, as explained above, due to the potentially large and heterogeneous control network that can include, e.g., a corporate intranet, the Internet, a mobile communication network and so on. The control network mentioned in this disclosure is not installed between the luminaires and the network router, but solely between the network router and the control device.

In a preferred embodiment, at least one of the number of luminaires provides a webpage and the command forwarded to the at least one luminaire changes a setting of the webpage provided by the at least one luminaire. It shall be understood, though, that a luminaire does not have to offer a webpage in order to be able to respond to HTTP- or CoAP-commands.

For instance, the webpage provided by the luminaire is based on HTTP and/or on CoAP. Because HTTP is widely used on the Internet as a protocol for web browsing and Web Services, many embedded products, such as luminaires, nowadays also support the HTTP protocol. An advantage of this embodiment is that a luminaire offers a webpage that a user can view and change settings in. Another advantage is the possibility to directly accept commands from the control device/from the network router based on HTTP requests. This can also be referred to as "HTTP REST API". For example, a custom HTTP interface is defined to control a lamp via an IP network. Then, a command to turn on a luminaire and turn it into a certain color looks like the following exemplary HTTP GET-request:

GET http://130.145.2.3/lamp?state=on&color=0xFF0000

Such HTTP GET-request contained in the control message does not have any payload data—all information is encoded in the request uniform resource identifier (URI) itself in the form of HTTP query parameters. The same approach is possible for the CoAP protocol and other protocols, in particular further REST (REpresentational State Transfer-based protocols.

For combining an above mentioned HTTP/CoAP command with timing information, the control message includes, in an example, a HTTP GET request or a CoAP GET request, where all relevant control information is encoded into a Request URI (Uniform Resource Identifier). Alternatively, these could be HTTP PUT or CoAP PUT requests with a payload attached.

In an embodiment, the control message payload section is adapted to the requirements of the luminaires to be controlled. However, generally, the control message payload section can be a text format, e.g., an XML format, a compressed XML format, a JSON format, and/or a custom binary format, and/or any other content type defined for HTTP/CoAP standards.

One possible representation of the timing information for doing the HTTP/CoAP requests is given now. Other representations are possible. A possible definition for a control message could be a HTTP PUT request from the control device to the network router, carrying as payload a list of time/method-code/URI triplets, as shown next, in ASCII text format 0.0 GET coap://lamp1.domain.example.com/set?level=23&status=on 2.0 GET coap://lamp2.domain.example.com/set?level=13&status=on 2.0 GET coap://lamp3.domain.example.com/set?level=17&status=on&color=0xFF0101

According to this example, a first luminaire ("lamp1") is turned on immediately after the reception of the control message, whereas a second ("lamp2") and a third luminaire ("lamp3") are turned on two seconds ("2.0") later.

The timing information can be extended. For instance, in a further example, the timing information defines multiple points in time at which the network router shall forward a command. A control message containing such timing information can look like:

1.2 5.8 15.0 23.0 GET coap://lamp1.domain.example.com/set?level=23&status=on

Another example for a control message with two or more commands is one that allows repeating commands:

1.0 repeat 15 every 2.0: GET coap://lamp1.domain.example.com/set?level=23

1.3 repeat 15 every 2.0: GET coap://lamp1.domain.example.com/set?level=9

This sets a lamp initially to a high level and 300 ms later to a lower level. The sequence is repeated 15 times every 2 seconds. In an embodiment, a script language is used (e.g. Python, Perl, Ruby, php, JavaScript or a simplified version thereof) or even a bytecode-interpreted programming language (Java, C#) for defining more complex timing information, e.g. by using variables, performing math and using advanced control statements (for/while/if-then/switch/ . . . ).

Basic time information is, in an embodiment, encoded in floating point values in seconds. Also, an integer in milliseconds encoded in ASCII is suitable, or an integer encoded in big-endian UIINT32 for easier parsing. Such timing information is preferably followed by a white space, preferably followed by the CoAP or HTTP request code (e.g., "GET" or "PUT" or "POST" or "DELETE"), preferably followed by the URI (Uniform Resource Identifier), including the address, to make the HTTP/CoAP request to. Payloads for the CoAP requests listed above are neither needed nor used/defined in this example due to the specific API (Application Programming Interface) of the luminaires (lamps 1 to 3) in which all relevant information is encoded into the request URI. So only a method (GET, POST, etc.) plus a request URI is defined to completely indicate a HTTP or CoAP request to be done.

As elucidated above, it is preferred that the network router includes one or more timers and that the timing information describes a relative time that has reference to the one or more timers running in the network router. In the example mentioned above, a control message included three commands to be directed to three luminaires (lamp1, lamp2, lamp3) at specific points in time, namely at the first point in time t=0s (zero) and at the second point in time t=2s. Sometime later, the control device may provide a second control message, wherein the lowest specified time is non-zero. This indicates to the network router that reference is made to a previously established time base, i.e. the timer used in processing of the previously received control message above. For example:

12.0 GET coap://lamp1.domain.example.com/set?status=off 14.0 GET coap://lamp2.domain.example.com/set?level=1&status=n In this case, upon decoding the second control message, the network router preferably identifies which timer was used for that session-based on an IP source address of the second control message (which matches the first IP source address in the first control message).

Accordingly, in another embodiment, the control message provided by the control device additionally includes a session identifier or a "cookie". The session identifier facilitates precise timing control of the number of luminaires by more than one control device. For instance, the number of luminaires (e.g., ten luminaires) are coupled to the network router, and a first control device and a second control device are coupled to the network router via the control network, wherein the first control device controls a first part of the number of luminaires (e.g., luminaires 1 to 5) and wherein the second control device controls a second part of the number of luminaires (e.g., luminaires 6 to 10). In order to advantageously offer the functionality described with respect to the examples above, where the network router includes a timer that is referred to by the timing information included in the control message, the network router now preferably includes more than one timer and is configured for differentiating the control messages sent by the different control devices. Thus, the session identifier (USI) is preferably included in the control message, such that the control device or an application (also referred to as "app") running on the control device, can refer to a previously established time base via the session identifier. Hence, it is preferred that the session identifier refers to a specific one of the plurality of timers running in the network router.

In an embodiment, the network router is configured to convert HTTP into CoAP and preferably vice versa. This allows for controlling CoAP luminaires also via a control device that is based on HTTP only, e.g. a smartphone, PC or a Web Service on the Internet. Because CoAP is relatively new and still being standardized, there are currently hardly any CoAP controlled luminaires on the market but this is expected to change after standardization finalizes in the year 2012/2013. For instance, a HTTP control message is sent from a mobile device like a tablet or smartphone as the control device to a network router including a network Proxy and a 6LoWPAN (IPv6 over Low Power Wireless Personal Area Network) Border router, wherein the network router translates the HTTP control message through a built-in HTTP-CoAP cross-protocol mapping proxy into a CoAP packet format. The translated message is transmitted, by the network router, over a User Datagram Protocol (UDP) over IP/6LoWPAN for the constrained IEEE 802.15.4 network segment that interconnects the number of luminaires. However, it shall be understood that for the invention, the particular application protocol format does not matter.

If the lighting system comprises a further control device configured to be coupled to the network router via the control network, and if the control devices intend to control the same luminaire at a same point in time via the network router, it is preferred that the method comprises the additional step of:

implementing, by the network router, a priority management procedure, such that it is ensured that only one of the control devices controls the luminaire.

For example, implementing the priority management procedure comprises the steps of:

sending, by the control device, a priority request message to the network router;

receiving, by the network router, the priority request message via the control network;

assigning, by the network router, a priority level for the control device, wherein the priority level is associated with one or more of the number of luminaires; and receiving, by the control device, the assigned priority level.

This embodiment facilitates precise timing control of the number of luminaires, in particular in a case where a luminaire is controlled by more than one control device; e.g. a first control device and a second control device being coupled to the network router via the control network and controlling the same luminaire(s). This embodiment allows for implementing access policies. In an example, a first control device is assigned with a priority level that yields exclusive access to a specific luminaire for the first control device. A second control device is assigned with another priority level that consequently ensures that the second control device cannot submit commands to said specific luminaire. Certainly, it is possible to define more differentiated priority levels, e.g., on a scale from 1 to 10. Thus, a control message received by the network router from a control device is treated in dependence on the priority level indicated in the control message, wherein the control message including the highest priority level is processed first. Thus, it is furthermore preferred that the method additionally comprises the step of including, e.g. by the control device, the assigned priority level in the control message.

For instance, in the embodiment described above, the control device asks the network router, via the priority request message, about a control state of a certain luminaire. The network router informs the control device about the control state (e.g. "controlled" or "controlled by control device xy" or "controlled by control device xy@priority level p1" or "not controlled"), such that the control device or the user of the control device can decide whether or not to submit a control message addressed to the certain luminaire.

For improving the avoidance of any control conflicts, it is preferred that the priority request message is sent by the control device before providing the control message.

In another embodiment of the method that comprises the step of implementing, by the network router, the priority management procedure, the network router handles all priority processing without active participation of the control devices. In this embodiment, the two or more control devices do not send priority requests or receive information about assigned priorities. This embodiment can be set up as follows: In an exemplary embodiment, a mechanism inside the network router inspects all control messages from all control devices in order to detect conflict situations where two or more controllers are both trying to control the same luminaire. The detection of such a conflict situation is implemented, for example, by considering if two or more separate control devices have each sent a control message related to this luminaire with respective timing information that are less than two seconds apart from each other. If such a conflict situation is detected (and as long as it exists), the network router that implements the priority management procedure preferably prevents all control messages from the control devices involved, except for those from a single control device with the highest priority, from being converted into commands which are forwarded to the applicable luminaire. To determine which of the conflicting control devices should have the highest priority, a number of procedures can be used by the network router. In a first example, the network router uses a table that assigns a numeric priority level to each control device, with this assignment being based on a control device identity or another device characteristic. The network router preferably looks up the control device identity/control device characteristic of a respective control device in a table created earlier. The network router assigns the control device with the highest numeric value with the highest priority. In a second example, the network router assigns the highest priority to the first (or last) control device that joined the group of (conflicting) control devices for the luminaire. These two examples can also be combined, e.g. the second example can be used to choose between two control devices that have the same numeric priority value according to the first example. It shall be understood that the two seconds mentioned above are certainly only an exemplary time distance. The time distance between two or more conflicting control messages can certainly be shorter or longer.

In an embodiment, the control message includes a User Datagram Protocol (UDP) request. For example, a CoAP protocol is used in addition to a UDP protocol in a 6LoWPAN constrained network that interconnects the number of luminaires with each other.

In another embodiment, the method further comprises:

buffering, by the network router, the received control message for a predetermined time period;

checking, by the network router, whether an additional control message is received within the predetermined time period; and processing the control message, if no additional control message arrives or if it is determined that the additional control message is not related to the earlier control message; and processing the additional control message, if the additional control message is related to the earlier control message and if it is indicated that the additional control message is to be processed before the earlier control message.

This embodiment facilitates precise timing control of luminaires, in particular in the case where control messages sent by one or more control devices do not arrive at the network router in the same order in which they have been submitted, but rather out-of-order. Such a scenario can, e.g., occur in a UDP -based network. A possible reason for such out-of-order reception is that a distance (in terms of hops/latency) between a first control device and the network router can deviate dramatically from a distance between a second control device and the network router. Or, alternatively, different control messages submitted by a single control device are forwarded by the control network in a different manner, implying that a first control message submitted at t=0s arrives later than a second control message submitted after t=0s. To avoid conflicts resulting from such out-of-order reception at the network router, this embodiment essentially provides buffering of a received control message for a predetermined time period. The duration of the predetermined time period can be adapted to the requirements of the lighting system to be controlled and can, e.g., vary between 20 milliseconds and 2 minutes.

The relation between the earlier and the further control message can be identified, e.g., by recognizing that both messages are directed to the same luminaire(s) and/or by recognizing that both messages refer to a common time base and/or recognizing that both messages were sent by the same source. Such related messages can also be so-called "follow-up messages".

The indication that the further control message is to be processed before the earlier control message is, in an embodiment, implemented by the control device, e.g., by including a time stamp, such as order indication and/or an absolute time, in the control message.

Thus, a further control message that arrives at the network router after an earlier control message can under circumstances be processed before the earlier control message, such that the network router puts control messages received out-of-order in the right order.

In another embodiment, conflicts with out-of-order control messages are avoided by providing a further control message only if the network router has acknowledged to the control device that an earlier control message has been processed.

In yet another embodiment, which can be combined with one or more of the above mentioned embodiments, conflicts with out-of-order control messages are avoided in that the control device provides the same or a modified control message that contains adapted command information and/or adapted timing information, the same/modified control message being addressed to the same luminaire(s).

Such a control message can be provided to the network router periodically. For example, the control device sends updated control messages relatively frequently to the network router containing updated commands for the luminaire(s). This reduces, e.g., the time during which a wrong light setting is active due to an earlier out-of-order message delivery.

In the above described embodiment, the term "periodically" also includes the case where only one further (same or modified) control message is provided by the control device. Preferably, the network router derives the command of the command information from the further control message and overrides/substitutes the command derived from the earlier control message with the command derived from the further control message.

In an example, the control device sends the following first control message:

0.0 GET coap://lamp1.domain.example.com/set?lamp=on&color=blue&fade=34
14.0 GET coap://lamp2.domain.example.com/set?lamp=on&color=red&fade=34
25.0 GET coap://lamp1.domain.example.com/set?lamp=off&fade=134
25.0 GET coap://lamp2.domain.example.com/set?lamp=off&fade=134

After a time period, e.g., 15 seconds later, the control device sends the following further control message:

20.0 GET coap://lamp1.domain.example.com/set?lamp=on&color=green&fade=34
21.0 GET coap://lamp2.domain.example.com/set?lamp=on&color=green&fade=34
30.0 GET coap://lamp1.domain.example.com/set?lamp=off&fade=134
32.0 GET coap://lamp2.domain.example.com/set?lamp=off&fade=134

As indicated above, the first number contained in each of the commands of the first and the further control message indicates the time in seconds that have to elapse until the respective command is to be submitted to or to be received by the designated luminaire. Accordingly, the further control message is probably received by the network router before 25 seconds have elapsed (last command in first control message), assuming that the network latency from control device to network router is less than 10 seconds. Preferably, the network router recognizes that a time value 20.0 is the lowest in the further control message (first command in further control message), which is lower than the scheduled 25.0, hence it removes all scheduled events after time value 20.0. In this embodiment, the network router assumes that the further control message (i.e., a further schedule) updates a previous control message (i.e., a previous schedule).

In yet another preferred embodiment, an additional control message sent by the control device further includes an instruction to the network router, the instruction causing the network router to replace any commands that were contained in a control message received earlier and that have not been executed yet.

If the later control message is permanently lost, e.g., due to failure of a component in the control network, then the network router can preferably still execute/process the earlier received control message. It should be noted that it is preferred that the last command contained in the control message is a turn-off command. In the example above, namely luminaires "lamp1" and "lamp2" are turned off/slowly fade out, at time t=25.0. This kind of "if-fail" behavior, which is preferably defined in the control message, avoids that the luminaires stay on forever after a control network failure would cause the further control message to never arrive at the network router.

In the embodiment described above, which includes the step of periodically providing, by the control device, the same or a modified control message to the network router, it is preferred that the control device includes a previously provided control message again into a later control message. This helps dealing with the case that the previous control message is lost or delayed. In an example, the previous control message is labeled as first in a sequence and contains:

0.0 GET coap://lamp1.domain.example.com/set?lamp=on&color=blue&fade=34

14.0 GET coap://lamp2.domain.example.com/set?lamp=on&color=red&fade=34

25.0 GET coap://lamp1.domain.example.com/set?lamp=off&fade=134

25.0 GET coap://lamp2.domain.example.com/set?lamp=off&fade=134

And the later control message, sent, e.g., about 15 seconds later, is labeled as second in a sequence and contains:

0.0 GET coap://lamp1.domain.example.com/set?lamp=on&color=blue&fade=34

14.0 GET coap://lamp2.domain.example.com/set?lamp=on&color=red&fade=34

20.0 GET coap://lamp1.domain.example.com/set?lamp=on&color=green&fade=34

21.0 GET coap://lamp2.domain.example.com/set?lamp=on&color=green&fade=34

30.0 GET coap://lamp1.domain.example.com/set?lamp=off&fade=134

32.0 GET coap://lamp2.domain.example.com/set?lamp=off&fade=134

Alternatively, the aforementioned UDP communication is replaced by a Transmission Control Protocol (TCP) for avoiding conflicts with out-of-order messages. However, it might be that one or more of the number of luminaires is not configured for such TCP communication.

It might further occur that a control message (e.g. a CoAP message) sent in accordance with UDP gets lost in the control network. For this purpose, the CoAP defines a reliable form of transport (e.g. CON, Confirmable type messages), according to which a destination (luminaire) responds with acknowledgements (ACK). Retries are also supported.

It is preferred that, if a control message provided by the control device gets lost in the control network (even after several retries), a CoAP protocol component included in the control device preferably informs the application running on the control device of this fact. Then, it is up to the application, i.e., the user of the control device, to decide what to do. Alternatively or additionally, if the control message gets lost, the network router informs the control device of this fact by a suitable CoAP response. This response preferably contains a payload indicating which command(s) to which luminaire(s) could not be forwarded. Then it is up to the controlling application to decide what to do.

According to the aforesaid, it is generally preferred that the control message includes a Uniform Resource Identifier (URI), or components thereof, preferably a URI indicating an embedded HTTP/CoAP request plus values indicating the timing information.

The luminaires are preferably IP devices using, e.g., HTTP and/or CoAP.

According to a second aspect of the present invention, a computer program for operating a lighting system is presented. The computer program comprises program code means for causing the lighting system to carry out the steps of the method according to the first aspect of the invention, when the computer program is run on a device controlling the lighting system.

The computer program of the second aspect of the invention may be stored and distributed on a suitable medium, such as an optical storage medium or a solid-state medium supplied together with or as part of other hardware, but may also be distributed in other forms, such as via the Internet or other wired or wireless telecommunication systems.

According to a third aspect of the present invention, a lighting control system for controlling a number of luminaires is presented. The lighting system comprises a network router configured to be coupled to the number of luminaires and a control device configured to be coupled to the network router via a control network, wherein the control device is further configured for providing a control message, the control message including timing information and command information; and the network router is further configured for:

receiving the control message via the control network;

determining a first point in time in dependence on the timing information;

generating a command in dependence on the command information; and forwarding the command at the determined first point in time to at least one of the number of luminaires identified in the control message.

According to a fourth aspect of the present invention, a control device for controlling a number of luminaires is presented. The number of luminaires is configured to be coupled to a control network via a network router. The control device is configured to be coupled to the network router via the control network. Further, the control device is configured for:

providing a control message, the control message including timing information and command information, wherein the control message is configured to be received by the network router such that the network router can determine a first point in time in dependence on the timing information, generate a command in dependence on the command information and forward the command at the determined first point in time to at least one of the number of luminaires identified in the control message.

According to a fifth aspect of the present invention, a network router for controlling a number of luminaires is presented. The number of luminaires is configured to be coupled to a control network via the network router. A control device is configured to be coupled to the network router via the control network. The network router is configured for:

receiving a control message via the control network, wherein the control message has been provided by the control device and includes timing information and command information;

determining a first point in time in dependence on the timing information;

generating a command in dependence on the command information; and forwarding the command at the determined first point in time to at least one of the number of luminaires identified in the control message.

The computer program, the lighting control system, the control device and the network router according to the further aspects of the present invention share the advantages of the method according to the first aspect of the invention. The computer program, the lighting control system, the control device and the network router according to the further aspects have embodiments that correspond to the embodiments described with respect to the method of the first aspect, in particular as defined in the dependent claims.

Accordingly, in a preferred embodiment of the network router, the network router is/includes a network proxy configured to receive the control message. Preferably, the network router includes a built-in timer. The command information preferably includes a HTTP-request and/or a CoAP-request.

In an embodiment, the network router is configured to implement a RTT measurement for determining the point in time for forwarding the derived command, such that the forwarded command is received by the respective luminaire at a point in time specified in the timing information of the control message.

The invention can advantageously be applied within the following exemplary network set-up: the control network is at least partially an Internet Protocol-based control network and includes at least one of the Internet, an Intranet, a mobile communication network, a wireless and/or wired control network and/or a combination thereof. The control device is, e.g., a subscriber terminal of the control network, such as a Personal Computer, a mobile terminal, a handheld device, a tablet device or mobile phone or the like. Preferably, the control device is operatively connected upstream to the control network, the control network is operatively connected upstream to the network router and the network router is operatively connected upstream to the number of luminaires.

For instance, the control network includes a 3G/4G-mobile communication network, an Ethernet LAN, or an IEEE 802.15.4 network. The control device is, e.g., a tablet device.

In a preferred embodiment, the control message includes at least one of a Hypertext Transfer Protocol (HTTP) request, a secure Hypertext Transfer Protocol (HTTPS) request, a Constrained Application Protocol (CoAP) request, a secure Constrained Application Protocol (CoAPS) request, a Datagram Transport Layer Security (DTLS) protocol request, a Universal Plug and Play Protocol (UPnP) request, a Web service request, such as a Web Application Programming Interface (WAPI) Protocol request, a Simple Object Access Protocol (SOAP) request, User Datagram Protocol (UDP) datagram, a Transmission Control Protocol segment and/or a combination thereof. For instance, secure CoAP is used over UDP.

In an embodiment, the network router is coupled to the number of luminaires via a packet-based networking system. Preferably, the network router exploits specific properties of, or uses specific protocols over, this packet-based networking system in order to improve delivery of commands derived from of the command information to the luminaires.

In a first example, the network router makes more efficient use of available network bandwidth by combining commands for at least two luminaires in a single packet that is sent into the packet-based networking system. Specifically, the network router uses the command information contained in one or more received control messages to generate and forward, on said packet-based networking system, a single packet containing one or more commands for at least two of the number of luminaires.

In some packet-based networks, to ensure that such a packet is received by both of the at least two luminaires, a broadcast or multicast type of packet is preferably used.

In other types of networks, all packets are implicitly of a broadcast nature, i.e., they are received by all participating luminaires in the packet-based network. Preferably, in both cases, a luminaire receiving the packet at least partially decodes the packet content to determine if any command addressed to the luminaire is present in the packet. In some cases, e.g., if all luminaires have to be switched off at the same point in time, the network router preferably generates a single global command in the packet that will trigger action in every luminaire that receives the packet. In other cases, e.g., if a first luminaire L1 needs to turn green and a second luminaire L2 needs to turn red at the same point in time, two commands might be included in the same packet: 'L1 turn green' and 'L2 turn red'.

Preferably, the number of commands to be forwarded is reduced by the network router by leveraging a system of group identities or group addresses, wherein all luminaires have been equipped with information determining which group(s) they are member of, and wherein luminaires will consult such information to see if they need to respond to a specific command, e.g., 'group A turn blue'.

In a second example, the network router uses a broadcast facility or a multicast facility of said packet-based networking system to forward the command as, respectively, a single broadcast command or as a single multicast command to at least two of the number of luminaires.

Broadcast or multicast can be used beneficially sometimes because it can be more efficient than sending the command using unicast. In some networking systems, by sending a command via broadcast/multicast, not unicast, the triggering of an acknowledgement message is avoided. Thus, in some cases, even if the command is only intended for a single luminaire, and if all other luminaires will discard the command when receiving it, it can still be beneficial to use the broadcast/multicast mechanism because it suppresses an acknowledgement message, thus reducing the time that the transmission medium is in use. In wireless networks, which use multi-hop routing to reach far-away nodes outside the immediate radio range of the router, it can be beneficial for the network router to use (un-routed) broadcast/multicast messages to address nodes within radio range, and (routed) unicast to reach nodes outside the radio range.

Preferably, the network router is set up such that it dynamically switches between using broadcast/multicast style command delivery and (acknowledged) unicast style command delivery for particular luminaires, preferably based on particular patterns of usage by the control device. For example, if the control device sends a series of control messages that continuously adjust the light settings, e.g., four times a second, the network router preferably switches to broadcast/multicast style command delivery, such that the speed of message delivery to the luminaires over the applicable packet-based network is increased.

Generally spoken, the invention also supports a trend called "Internet of Things", which means that an ever growing number of electronic devices will become Internet-connected. An Internet Protocol (IP) connection can add value to a product or group of products through communication with Internet services or other connected Things over IP. Although occasionally custom protocols on top of TCP/IP or UDP/IP are implemented in products nowadays, there is a trend towards more standardized approaches such as UPnP, Web Service APIs (WADL/WSDL/WS4D/SOAP) or HTTP, or CoAP for use in resource-constrained devices. Any of these approaches will be referred to as "IP control" in the description of the present invention, wherein the IP can in particular be the IPv6 or the IPv4 protocol. HTTP is often a basis for current standardized connectivity, while CoAP is expected to take on the role of HTTP for resource-constrained devices in the future.

For embedded internet connectivity, Internet Engineering Task Force (IETF) standards are preferably used.

In a preferred embodiment, the luminaires are interconnected in an IEEE 802.15.4 -based network coupled to the network router. It is remarked that CoAP is standardized within the Constrained Restful Environments (CoRE) Working Group of IETF. CoAP aims to achieve a highly compact data format so that a CoAP control message would typically fit in a single 802.15.4 127-byte radio frame.

The present invention is in particular suited to be used in the following exemplary applications: Dynamic lighting that is controlled by events derived from an audio track (mood with light & music); dynamic lighting control to match events in a game played on a tablet (e.g., Android tablet) or home PC or the like; control home lighting automatically in a natural way as an anti-burglary measure; control home lighting based on occupancy sensing; ambient lighting scenes e.g. customized dinner mode, relax mode or reading mode; professional lighting systems where luminaire(s) is/are dynamically controlled, for example smartphone-based control of luminaires in offices or use of IP-based RGB lighting installed in a shopping center based on a specially written "Christmas-app" running on a PC or tablet or cloud server or embedded IP controller; home lighting systems where one or more luminaires are dynamically controlled, for example, two "LivingColors" lamps controlled by a smartphone app in conjunction with music, or a room-wide Ambilight effect controlled by an IP-connected TV set.

Furthermore, the present invention is specifically useful for applications in both consumer and professional lighting systems with one of more of the following properties:

- Dynamic and simultaneous changes in lighting are required for one luminaire or multiple luminaires. Example: lighting changes are linked to a game and/or ambient lighting is linked to playing audio or video content (such as "Ambilight in the entire room"), or: a creative application with light that requires user input, such as a professional dynamic light installation in a hall that responds to operator settings submitted with a handheld/tablet device which is network-connected via a 3G connection.
- Low latency is preferred for changes in light-setting, but not necessarily required.
- A high degree of synchrony is required. Example: multiple lamps change color/intensity/settings preferably at the same moment in time or at specific time-shifted points in time.
- Precise timing is sometimes required or preferred. Example: lighting colors should change at precise points in time synchronized to a music track playing; or: "strobe light" effect is enabled, which requires lights to switch on/off at an exact frequency (e.g. 4 Hz or 8 Hz) while the exact starting time of the strobe effect is of less importance.
- Network connectivity from a controlling application to the lights to be controlled is restricted in its throughput and/or latency.
- The control device is not in direct radio communication with the devices to be controlled. At least two hops are needed to reach any destination device (luminaire) from the control device. The control network between the control device and the destination devices may have many hops and unpredictable, variable latency. Example: a situation where a PC/smartphone/tablet connects over Wi-Fi infrastructure indirectly to IEEE 802.15.4 RF-controllable lamps and buffering issues in the Wi-Fi router occasionally cause a high variation in latency of IP packets to/from Wi-Fi clients. Another example: a similar situation where a smartphone/tablet connects over a 3G/GSM infrastructure indirectly to 802.15.4 RF-controllable lamps.
- The network connectivity to the luminaires uses an 802.15.4-based protocol like ZigBee or 6LoWPAN, a version of the Internet Protocol (IPv6) mapped to a low-bandwidth wireless technology, or a similar packet-based technology adhering to the end-to-end communication principle. A feature here is that, in normal scenarios where a lamp is remotely controlled, separate data packets are sent by a source (i.e. the control device) which travel independently to the multiple destinations (i.e. the luminaires to be controlled). The destinations send acknowledgement packets back to the source—if an acknowledgment is not received by the source, the source will assume that the previous packet got lost and it will retry sending a packet to the destination.

In particular, it shall be understood that the present invention differs from Synchronized Multimedia Integration Language (SMIL). This is a language for describing multimedia presentations along with timing information. SMIL programs, e.g., SMIL players, run on a certain host device, from which a SMIL document to be rendered is actively selected, e.g., by a user. Then, media objects defined in the SMIL document are rendered locally e.g. on a screen and loudspeakers according to the timing information defined in the SMIL document. In the present invention, it is preferred that a remote device, i.e. the control device, sends a data object, i.e. the control message, with timing information and a list of protocol requests (i.e., the command information) to a device, which does not render anything but just executes the protocol requests according to the timing information.

In summary, the present invention defines a HTTP or CoAP request message that combines one or more HTTP or CoAP requests along with timing information. The message is sent by a control device to a network proxy (i.e. a network router) via a control network. The network proxy decodes the message and subsequently controls destination devices, in particular luminaires, in a timed manner using the HTTP or CoAP requests. The network proxy is application-independent and also enables control of third party HTTP- or CoAP-based devices that are not aware of timed requests. Improved timing performance is obtained by choosing the network proxy location "close by", in terms of network hops and/or network latency, to the destination devices to be controlled.

It shall be understood that a preferred embodiment of the invention can also be any combination of the dependent claims with the respective independent claim.

Further, it shall be understood that instead of controlling luminaires, the control message, the control device and the network router and the computer program mentioned in this disclosure can also be used to advantageously control systems other than a lighting system, i.e. systems that include destination devices other than luminaires. For example, instead of controlling a lighting system, the network router forwards the generated command to one or more haptic (i.e., tactile) effect-generating devices, wind effect-generating devices, fog-generating devices, audio effect-generating devices, human motion-generating devices, network controllable graphics presentation devices, network controllable digital media Tenderers, and/or other destination devices that should be accurately and timely controlled. Thus, the present invention is not limited to controlling luminaires.

These and other aspects of the invention will be apparent from and elucidated with reference to the embodiments described hereinafter.

DETAILED DESCRIPTION OF EMBODIMENTS

Figure 1:
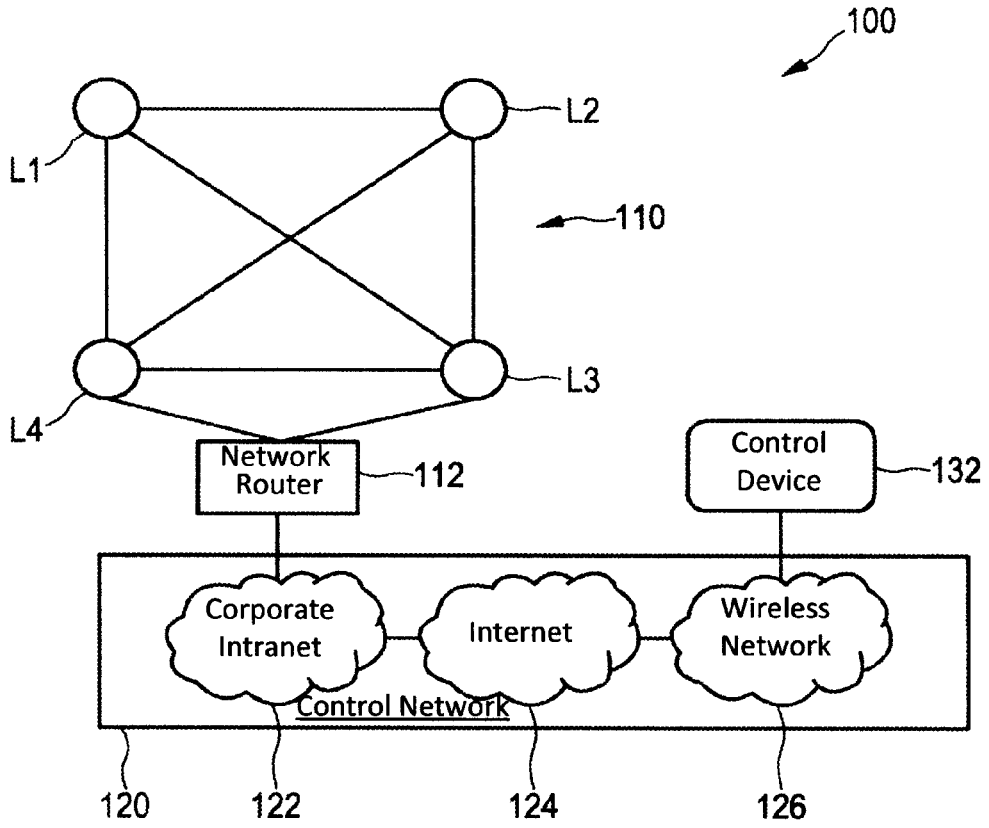
FIG. 1 shows schematically and exemplarily a representation of a lighting system that can be operated by an embodiment of the method of the present invention.

FIG. 1 shows schematically and exemplarily a representation of a lighting system 100 that can be operated by an embodiment of the method of the present invention.

The lighting system 100 includes a plurality of luminaires that are indicated by means of reference signs L1, L2, L3 and L4. For example, the luminaires are arranged in an IEEE 802.15.4 -based network and exhibit a corresponding interface.

The luminaires L1, L2, L3 and L4 are connected to a network router 112, e.g., a 6LoWPAN router including a network proxy. The luminaires L1, L2, L3 and L4 are to be controlled by a control device 132.

Network router 112 and control device 132 are coupled to each other via a control network 120. Such a control network can be a comparatively large and heterogeneous control network exhibiting a plurality of network hops, and signals traversing the control network 120 may likely exhibit a varying latency.

In the illustrated example, the control network 120 includes a wireless communication network 126, such as a 3G/4G network or an IEEE 802.11n-based network, the Internet 124 and a corporate Intranet 122. Accordingly, the control device 132 can be a mobile terminal, such as a mobile phone, a tablet device, a notebook, a Personal Digital Assistant, an IEEE 802.11n client device and so forth that is operated by a user.

In other words: The control device 132 for controlling the luminaires L1, L2, L3 and L4 is a subscriber terminal of the control network 120. It is operatively connected upstream to the control network 120, and the control network 120 is operatively connected upstream to the network router 112. The network router 112 is operatively connected upstream to the number of luminaires L1, L2, L3 and L4. For instance, the computer program of the second aspect of the present invention partially runs on the control device 132 and partially runs on the network router 112.

Figure 2:
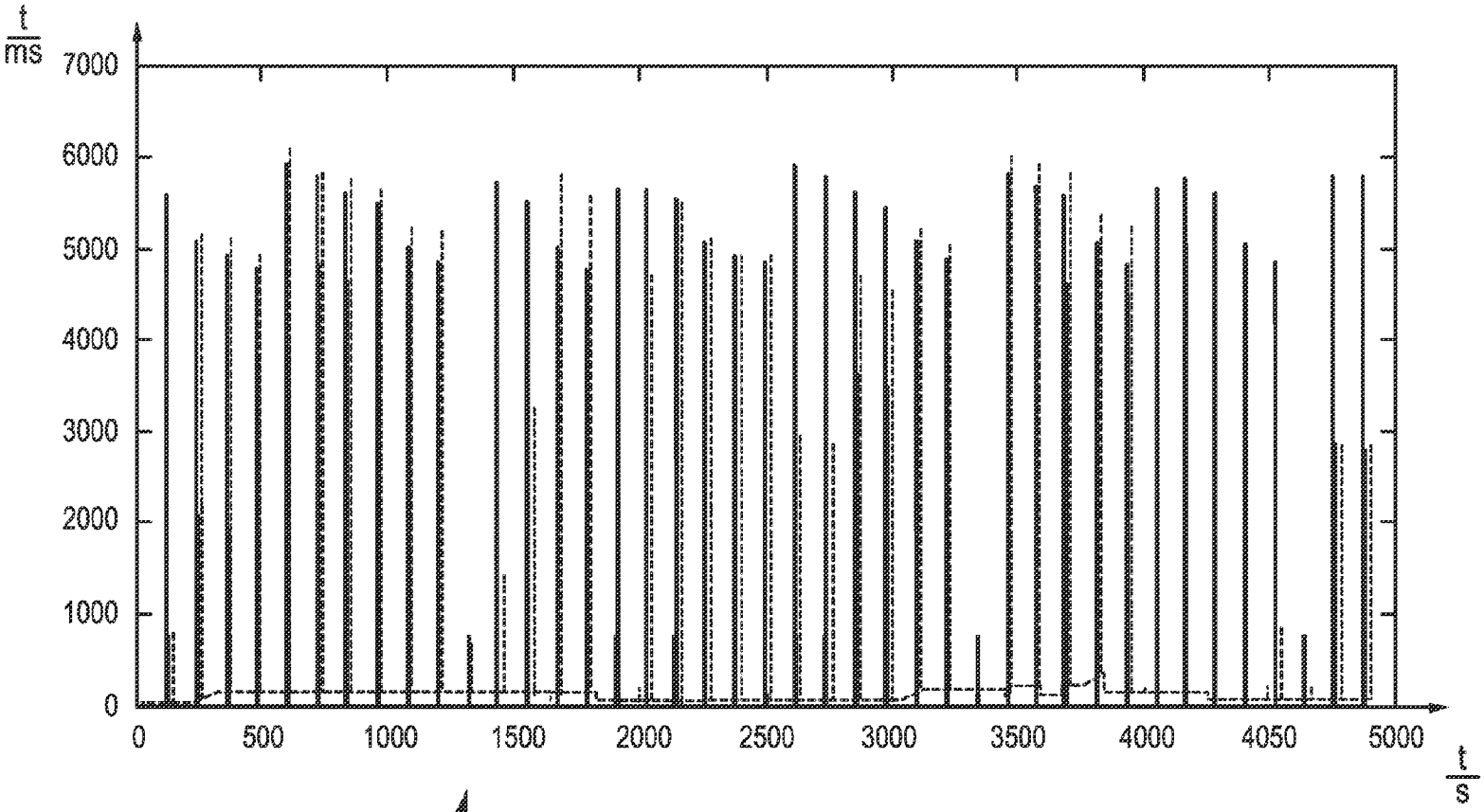
FIG. 2 shows schematically and exemplarily a representation of Round-Trip-Times (ping delays) of a signal over time that can occur during a trip from an access point to a client and during a trip from a client to an access point for illustrating a technical problem of the present invention.

For illustrating a technical problem of the present invention, FIG. 2 shows schematically and exemplarily a representation of measured Round-Trip-Times (which are also known as Ping Delays or Round Trip Delays) over time that can occur in a conventional IEEE 802.11n router under mild load conditions. Such a router can be part of the control network 120.

In FIG. 2, the ordinate indicates the RTT in milliseconds and the abscissa indicates the time in seconds. The continuous line indicates the RTT of a signal transmitted from an access point to a client over time and the dashed line indicates the RTT occurring with regard to a signal transmitted from the client to the access point.

Due to the unpredictable network traffic that can occur in a control network 120 and due to a large and varying number of network hops, the RTT varies dramatically over time, e.g., a signal sent at a first point in time can be some seconds faster than a signal sent at a second point in time. However, there are many further reasons for the varying of the RTT.

Specifically, according to FIG. 2, the RTT peaks up to about 6 seconds periodically.

Due to this phenomenon, precise timing control in a scenario as exemplarily illustrated in FIG. 1 is not possible according to the teaching of the prior art.

For handling varying network latencies, network hops etc., the control device 132 provides a control message that includes timing information and command information. The control message is received by the network router 112 via the control network. The network router 112 determines a first point in time in dependence on the timing information. Further, the network router 112 generates a command in dependence on the command information. Subsequently, the network router 112 forwards, at the determined first point in time, the command to at least one of the number of luminaires L1, L2, L3, L4 that is/are identified in the control message.

Figure 3:
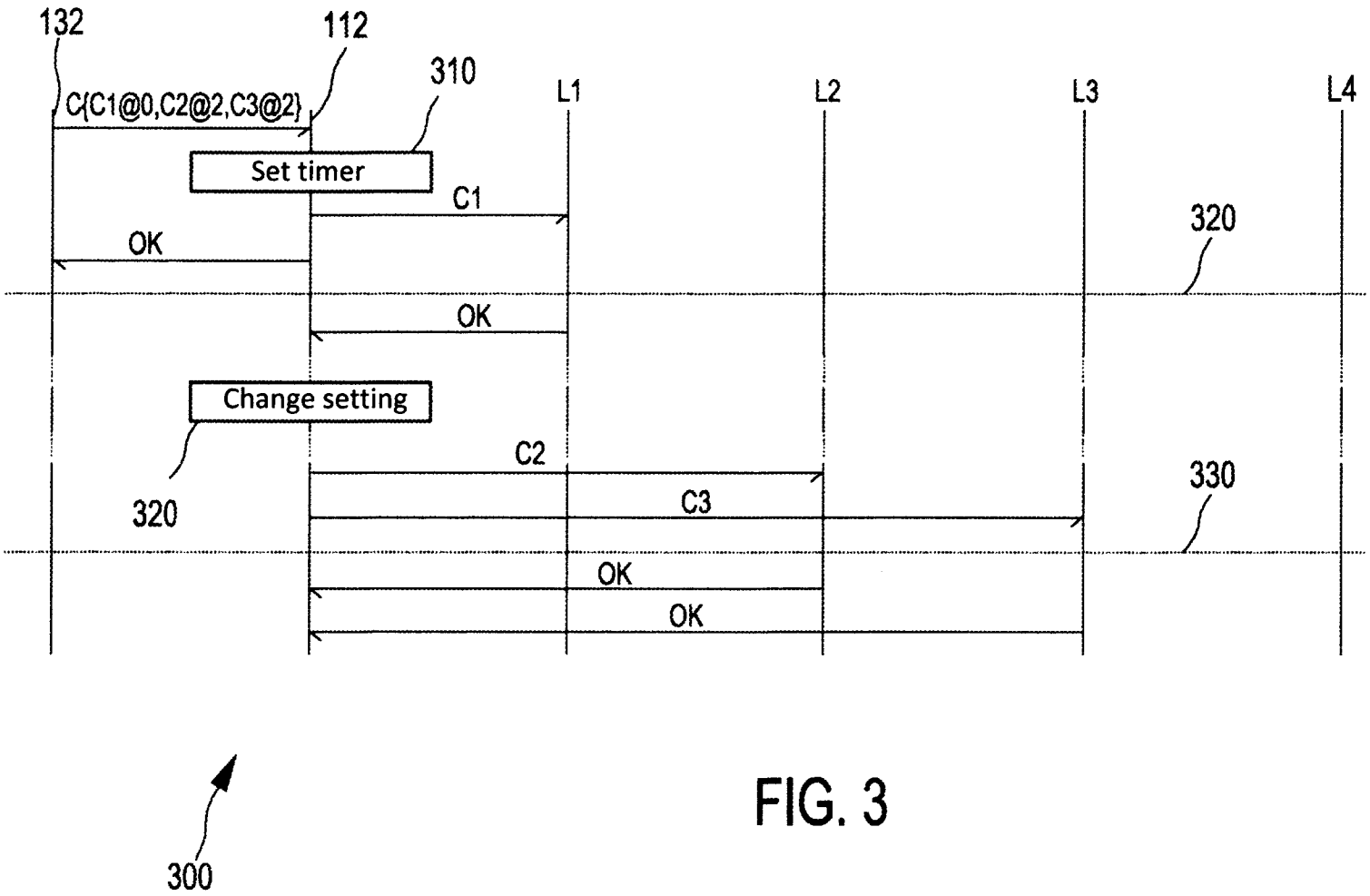
FIG. 3 shows schematically and exemplarily a representation of a control diagram that illustrates a specific embodiment of the method of the present invention.

The aforesaid is exemplarily illustrated in FIG. 3. In the illustrated example, the control message provided by the control device 132 includes three commands C1, C2 and C3. These commands can be, e.g., HTTP-requests or CoAP-requests. For each request, there is timing information included in the control message. This timing information specifies at which point in time a respective command is to be forwarded to the identified luminaire or at which point in time a respective command is to be received by the identified luminaire. For instance, the control message being processed according to FIG. 3 has a payload including the following:

0.0 GET coap://lamp1.domain.example.com/set?level=23&status=on 2.0 GET coap://lamp2.domain.example.com/set?level=13&status=on 2.0 GET coap://lamp3.domain.example.com/set?level=17&status=on&color=0xFF0101

According to this example, the timing information is represented by floating point values that indicate seconds (0.0/2.0/2.0). The floating point values are followed by a white space, followed by the CoAP request code ("GET"), followed by the URI that identifies the luminaire to which the CoAP request is to be made.

Accordingly, upon reception of such a control message, the network router 112 sets a timer (step 310) and then immediately forwards the first command C1, which is a turn-on command, to a first luminaire L1 ("lamp1"), since the timing information "0.0" indicates that the associated command 0.0 GET coap://lamp1.domain.example.com/set?level=23&status=on is to be forwarded as soon as possible.

After that, the network router 112 indicates to the control device 132 that command CI has been forwarded. Typically, a HTTP or CoAP response is sent by the network router 112 after receiving and processing the command information contained in the control message. Such response can be an "OK" (as indicated in FIG. 3) or an error code. Optionally, network router 112 can also send a result of a command forwarded to the luminaire(s) L1, L2, L3 and/or L4 back to the control device 132 at a later point in time.

Meanwhile, luminaire L1 confirms to the network router 112 that it has been turned-on, as illustrated by light-setting change line 320.

The network router 112 waits until two seconds ("2.0") have elapsed after the setting of the timer (step 330) and then immediately forwards command C2 to luminaire L2 and command C3 to luminaire L3. Luminaires L2 and L3 confirm to the network router 112 that their settings have been changed in accordance with the commands, as illustrated by light setting change line 340.

Figure 4A:
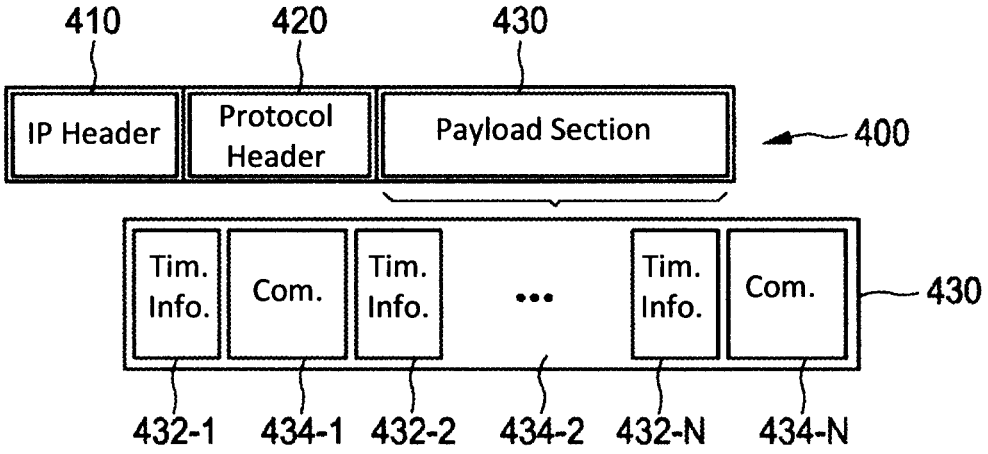
FIG. 4A shows schematically and exemplarily a set-up of a control message in accordance with the present invention.

FIG. 4A shows schematically and exemplarily a set-up of a control message 400 in accordance with the present invention.

The control message 400 includes an IP header 410, a protocol header 420, such as a HTTP-header or a CoAP-header, and a control message payload section 430.

The payload section 430 includes both command information specifying a number of commands 434-1 to 434-N and associated timing information (Tim. Info.)specifying points in time 432-1 to 432-N at which the network router 112 is to forward an associated command (Com.)or at which an associated command is to be received by the identified luminaire.

Figure 4B:
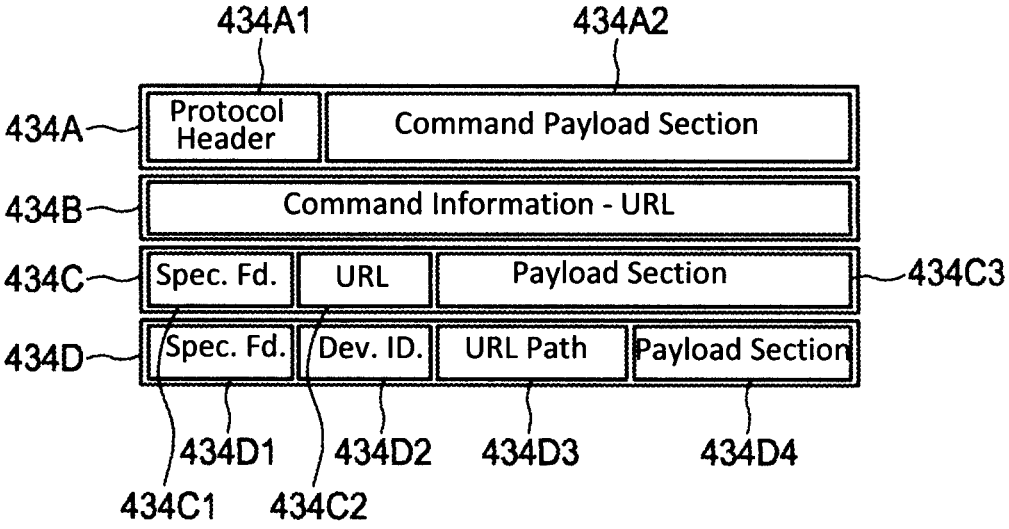
FIG. 4B shows schematically four examples for defining command information that can be included in the control message illustrated in FIG. 4A.

FIG. 4B shows schematically four examples of defining command information that can be included in the control message as illustrated in FIG. 4A.

In a first example, command information 434A is defined by at least one protocol header 434A1, such as a User Datagram Protocol (UDP) header, a HTTP header or a CoAP header, with an identifier contained therein, the identifier identifying one or more of the luminaires LI, L2, L3 and L4. The command information 434A is further defined by a command payload section 434A2, in which the actual command (e.g., "on", "off", "intensity=4", "dimming=on" and so forth) is contained.

In a second example, command information 434B is substantially entirely encoded in a command Uniform Resource Locator (URL). Such a URL can look like, e.g. "coap://lamp1.domain.example.com/ set?level=23&status=on". Such a URL further includes the identifier that identifies the luminaires(s) to which the command is to be forwarded.

In a third example, command information 434C is defined by a specification field (Spec. Fd.) 434C1 that specifies the type of command contained in the command information, such as the CoAP/HTTP requests "GET", "PUT", "POST", "DELETE" and so forth. Such command information 434C is further defined by a URL 434C2 and a payload section 434C3. The payload section 434C3 allows for integrating more specific lighting control commands, such as dimming time intervals, light intensity values, color values and so forth. In this example, the identifier is also included in the URL 434C2.

In a fourth example, command information 434D is defined by a specification field 434D1 that specifies the type of command contained in the command information, such as the CoAP/HTTP requests "GET", "PUT", "POST", "DELETE" and so forth. However, unlike the third example, the identifier is not included in the URL, but the command information 434D is further defined by an explicit target device identifier (Dev. ID.) 434D2, such as an IP address or an IP host name. Thus, instead of providing a complete URL, e.g. only a URL path 434D3 and optionally URL query parameters are provided. In comparison with the second example, such a URL path can look like, e.g. "set/lamp/1". Further, command information 434D is defined by a payload section 434D4, which may, e.g., include a command indicated by "level=23;status=on; color=1234".

In the embodiments described above, the lighting system contained four luminaires being arranged in an IEEE 802.15.4-based network. Certainly, the invention is not limited to such an arrangement but can also be applied in cases where there are more or fewer than four luminaires and in cases where the luminaires are arranged in a different network.

In the embodiments described above, the devices to be controlled are luminaires. However, the invention is not limited to controlling luminaires. Principally, any type of destination device can be controlled by the subject-matter (controlling method/system, computer program, network router and control device) of the present invention. Examples for alternative destination devices are given above.

It shall further be understood that an arrangement of elements of a respective figure predominately serves for the purpose of a plausible description; it does not relate to any actual geometric arrangement of parts of a manufactured device according to the invention.

In the claims, the word "comprising" does not exclude other elements or steps, and the indefinite article "a" or "an" does not exclude a plurality.

A single unit or device may fulfill the functions of several items recited in the claims.

Any reference signs in the claims should not be construed as limiting the scope.

The invention claimed is:

1. A method of controlling a lighting system, the lighting system comprising a number of luminaires, a network router configured to be coupled to the number of luminaires and a control device configured to be coupled to the network router via a control network, the method comprising:

providing, by the control device, a control message, the control message including timing information and command information;

receiving, by the network router, the control message via the control network;

generating, by the network router, a command in dependence on the command information;

determining, by the network router, in dependence on the timing information, a first point in time for forwarding the command to at least one of the number of luminaires identified in the control message; and forwarding, by the network router, at the determined first point in time the command to the at least one of the number of luminaires identified in the control message.

2. The method according to claim 1, wherein the timing information describes an absolute time having no reference to a previously established timer but to an internal clock running in the network router and/or in the control device; and/or a relative time having reference to a previously established temporary timer running in the network router and/or in the control device and/or having reference to timing information established via a previous communication between the control device and the network router.

3. The method according to claim 1, wherein the command information is first command information and the control message is a first control message, and wherein the method further comprises:

providing, by the control device, a second control message, the second control message including second timing information and second command information;

receiving, by the network router, the second control message via the control network; and, if the determined first point in time has not yet occurred:

discarding, by the network router, the first command information contained in the first control message received earlier than the second control message.

4. The method according to claim 3, wherein the lighting system comprises a further control device configured to be coupled to the network router via the control network, and wherein the method further comprises the step of implementing, by the network router, a priority management procedure, such that it is ensured that only one of the control devices which intend to control the same given luminaire at a same point in time via the network router controls the given luminaire.

5. The method according to claim 4, wherein implementing the priority management procedure comprises:

sending, by the control device, a priority request message to the network router;

receiving, by the network router, the priority request message via the control network;

assigning, by the network router, a priority level for the control device, wherein the priority level is associated with one or more of the number of luminaires; and receiving, by the control device, the assigned priority level.

6. The method according to claim 5, further comprising:

buffering, by the network router, the received first control message for a predetermined time period;

checking, by the network router, whether an additional control message is received within the predetermined time period; and processing the control message, if no additional control message arrives or if it is determined that the additional control message is not related to the earlier first control message; and processing the additional control message, if the additional control message is related to the earlier first control message and if it is indicated that the additional control message is to be processed before the earlier first control message.

7. The method according to claim 6, further comprising:

providing, by the control device, the same or a modified control message that contains adapted command information and/or adapted timing information, the same/modified control message being addressed to the same luminaire.

8. The method according to claim 7, wherein the control network is at least partially an Internet Protocol-based control network and includes at least one of the Internet, an Intranet, a mobile communication network, a wireless control network and/or a combination thereof; and wherein the control device is a subscriber terminal of the control network, the control device being operatively connected upstream to the control network, the control network being operatively connected upstream to the network router and the network router being operatively connected upstream to the number of luminaires.

9. The method according to claim 8, wherein the network router uses the command information contained in one or more received control messages to generate and forward, on said packet-based networking system, a single packet containing one or more commands for at least two of the number of luminaires.

10. The method according to claim 9, wherein the network router is coupled to the number of luminaires via a packet-based networking system, and wherein the network router uses a broadcast facility or a multicast facility of said packet-based networking system to forward the command as, respectively, a single broadcast command or as a single multicast command to at least two of the number of luminaires.

11. The method according to claim 10, wherein the control message includes at least one of a Hypertext Transfer Protocol request, a secure Hypertext Transfer Protocol request, a Constrained Application Protocol request, a secure Constrained Application Protocol request, a Datagram Transport Layer Security protocol request, a Universal Plug and Play Protocol request, a Web service request, such as a Web Application Programming Interface Protocol request, a Simple Object Access Protocol request, User Datagram Protocol datagram, Transmission Control Protocol segment and/or a combination thereof.

12. A non-transitory storage medium storing a computer program for controlling a lighting system, the lighting system comprising a number of luminaires, a network router configured to be coupled to the number of luminaires and a control device configured to be coupled to the network router via a control network, the computer program comprising program code for causing the network router and/or the control device to carry out the respective steps of the method as defined in claim 1, when the computer program is run on the network router and/or the control device, respectively.

13. A lighting control system for controlling a number of luminaires, the lighting system comprising a network router configured to be coupled to the number of luminaires and a control device configured to be coupled to the network router via a control network, wherein the control device is further configured for providing a control message, the control message including timing information and command information; and the network router is further configured for:

receiving the control message via the control network;

generating a command in dependence on the command information;

determining, in dependence on the timing information, a first point in time for forwarding the command to at least one of the number of luminaires identified in the control message; and forwarding the command at the determined first point in time to the at least one of the number of luminaires identified in the control message.

14. A control device for controlling a number of luminaires, wherein the number of luminaires is configured to be coupled to a control network via a network router and wherein the control device is configured to be coupled to the network router via the control network, the control device being configured for:

providing a control message, the control message including timing information and command information, wherein the control message is configured to be received by the network router such that the network router can generate a command in dependence on the command information, determine in dependence on the timing information a first point in time to forward the command to at least one of the number of luminaires identified in the control message, and forward the command at the determined first point in time to the at least one of the number of luminaires identified in the control message.

15. A network router for controlling a number of luminaires, wherein the number of luminaires is configured to be coupled to a control network via the network router and wherein a control device is configured to be coupled to the network router via the control network, the network router being configured for:

receiving a control message via the control network, wherein the control message has been provided by the control device and includes timing information and command information;

generating a command in dependence on the command information;

determining in dependence on the timing information a first point in time for forwarding the command to at least one of the number of luminaires identified in the control message; and forwarding the command at the determined first point in time to at least one of the number of luminaires identified in the control message.

* * * * *